US008167396B2

(12) United States Patent
Yonekubo

(10) Patent No.: US 8,167,396 B2
(45) Date of Patent: May 1, 2012

(54) LIQUID DISCHARGING APPARATUS AND CONTROL METHOD OF LIQUID DISCHARGING APPARATUS

(75) Inventor: Naoki Yonekubo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/035,009

(22) Filed: Feb. 25, 2011

(65) Prior Publication Data

US 2011/0211022 A1 Sep. 1, 2011

(30) Foreign Application Priority Data

Feb. 26, 2010 (JP) ..... 2010-042598

(51) Int. Cl.
*B41J 29/38* (2006.01)

(52) U.S. Cl. ..... 347/10; 347/11

(58) Field of Classification Search ..... 347/10, 347/11

See application file for complete search history.

(56) References Cited

U.S. PATENT DOCUMENTS

2004/0155915 A1* 8/2004 Kitami et al. ..... 347/10
2006/0209108 A1* 9/2006 Hamazaki et al. ..... 347/11
2009/0267980 A1* 10/2009 Satake ..... 347/11

FOREIGN PATENT DOCUMENTS

JP 2007-260933 10/2007

* cited by examiner

*Primary Examiner* — Julian Huffman
(74) *Attorney, Agent, or Firm* — Workman Nydegger

(57) ABSTRACT

A contraction portion of a vibration pulse includes a first contraction element which occurs subsequent to an expansion portion, a contraction maintaining element which follows the first contraction element, and a second contraction element which follows the contraction maintaining element, and when a time from a start point time of the expansion portion to an end point time of the expansion portion is set as t1, a time from the end point time of the expansion portion to a start point time of the contraction portion is set as t2, and a natural vibration period of ink in an ink flow path including a pressure chamber is set as Tc, the start point time (t1+t2) of the contraction portion is set to be in the range of any one of the following expressions (1) and (2).

$$(t1+t2)<t1/2+3Tc/8 \quad (1)$$

$$(t1+t2)>t1/2+5Tc/8 \quad (2)$$

4 Claims, 5 Drawing Sheets

| WIDTH FROM Pce TO Pds | EXISTENCE AND NONEXISTENCE OF DISCHARGE |
|---|---|
| 1 μs | NO DISCHARGE |
| 2 μs | DISCHARGED |
| 3 μs | DISCHARGED |
| 4 μs | DISCHARGED |
| 5 μs | NO DISCHARGE |

LIQUID DISCHARGING APPARATUS AND CONTROL METHOD OF LIQUID DISCHARGING APPARATUS

CROSS REFERENCES TO RELATED APPLICATIONS

The entire disclosure of Japanese Patent Application No. 2010-42598 filed Feb. 26, 2010 is expressly incorporated herein by reference.

BACKGROUND

1. Technical Field

The present invention relates to a liquid discharging apparatus such as an ink jet type printer and a control method of a liquid discharging apparatus.

2. Related Art

As a liquid discharging apparatus, there is a liquid discharging apparatus constituted so as to create a pressure change to liquid in a pressure generation chamber (a kind of pressure chamber) by generating a driving signal including a driving pulse (a discharge pulse) and applying (supplying) the generated driving pulse to a pressure generation element (for example, a piezoelectric vibrator, a heat generation element, or the like), thereby driving the pressure generation element, and to discharge liquid from a nozzle orifice communicated with the pressure generation chamber by using the pressure change. Also, in the liquid discharging apparatus constituted so as to generate a plurality of driving pulses which drives the pressure generation element, a micro-vibration pulse, which vibrates ink in the nozzle orifice to the extent that does not discharge ink from the nozzle orifice, is often supplied to the pressure generation element when ink is thickened due to exposure of a meniscus (a free surface of ink in the nozzle orifice) from the nozzle orifice, or the like.

The micro-vibration pulse is constituted to include a first charging element which changes voltage from a reference voltage up to a micro-vibration voltage, a first electrical discharge element which changes voltage from the micro-vibration voltage up to an intermediate voltage set between the reference voltage and the micro-vibration voltage, a second charging element which changes voltage from the intermediate voltage up to the micro-vibration voltage, and a second electrical discharge element which changes voltage from the micro-vibration voltage up to the reference voltage, as typified by, for example, JP-A-2007-260933, and by providing a plurality of kinds of vibrations, in which changes in voltage are different from each other, to ink in the pressure generation chamber or the meniscus in the nozzle orifice by supply of each of these elements, in which a voltage changing direction and an amount of change are different from each other, to the pressure generation element, and agitating ink by the vibrations, thickening of ink is suppressed.

However, in a case where natural thickening of ink is promoted, even if pressure fluctuations are provided, since it becomes more difficult for shaking of ink to occur, a need to further increase an agitation effect of ink in the pressure generation chamber arises. For this reason, consideration has been given to supplying a micro-vibration waveform, in which only a voltage change amount is increased, to the pressure generation element. However, up until now, in a case where a voltage change amount of a micro-vibration pulse is increased, with respect to residual vibration of the meniscus due to supply of the charging element to the pressure generation element, pressure fluctuations by an electrical discharge element which subsequently occurs are added, so that vibration of the meniscus is amplified, whereby there is a fear that ink will be erroneously discharged from the nozzle orifice. Also, in order to prevent this erroneous discharge, consideration has been given to increasing a duration which supplies the electrical discharge element of the micro-vibration pulse. However, since a waveform length of the entire micro-vibration pulse is lengthened, there is a problem in that high-frequency driving becomes impossible or the degree of freedom of design of a waveform is decreased.

SUMMARY

According to a first aspect of the invention, there is provided a liquid discharging apparatus including: a liquid discharging head which provides pressure fluctuations into a pressure chamber by an operation of a pressure generation element, thereby discharging liquid contained in the pressure chamber from a nozzle; and a driving signal generation section which can generate a driving signal including a micro-vibration pulse which drives the pressure generation element, thereby vibrating liquid in the nozzle to the extent that does not discharge liquid from the nozzle, wherein the micro-vibration pulse is a voltage waveform which includes a first voltage change portion in which voltage changes in a first direction and a second voltage change portion which occurs subsequent to the first voltage change portion and in which voltage changes in a second direction opposite to the first direction, the second voltage change portion includes a first change element which occurs subsequent to the first change portion and in which voltage changes in the second direction, a voltage maintaining element which follows the first change element and maintains termination voltage of the first change element, and a second change element which follows the voltage maintaining element and in which voltage changes in the second direction, and when a time from a start point time of the first voltage change process to an end point time of the first voltage change process is set as t1, a time from the end point time of the first voltage change process to a start point time of the second voltage change process is set as t2, and a natural vibration period of liquid in a liquid flow path including the pressure chamber is set as Tc, the start point time (t1+t2) of the second voltage change process is set to be in the range of any one of the following expressions (1) and (2).

$$(t1+t2)<t1/2+3Tc/8 \quad (1)$$

$$(t1+t2)>t1/2+5Tc/8 \quad (2)$$

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the best mode for carrying out the invention will be described with reference to the accompanying drawings and the like. In addition, in an embodiment described below, various limitations are given as the preferred specific examples of the invention. However, unless the description of intent to limit the invention is particularly given in the following explanation, the scope of the invention is not to be limited to these aspects. Also, in this embodiment, as one example of a liquid discharging apparatus, an ink jet type recording apparatus (hereinafter referred to as a "printer") is taken and described as an example and as one example of a liquid discharging head, an ink jet type recording head (hereinafter referred to as a "recording head") is taken and described as an example.

Figure 1:
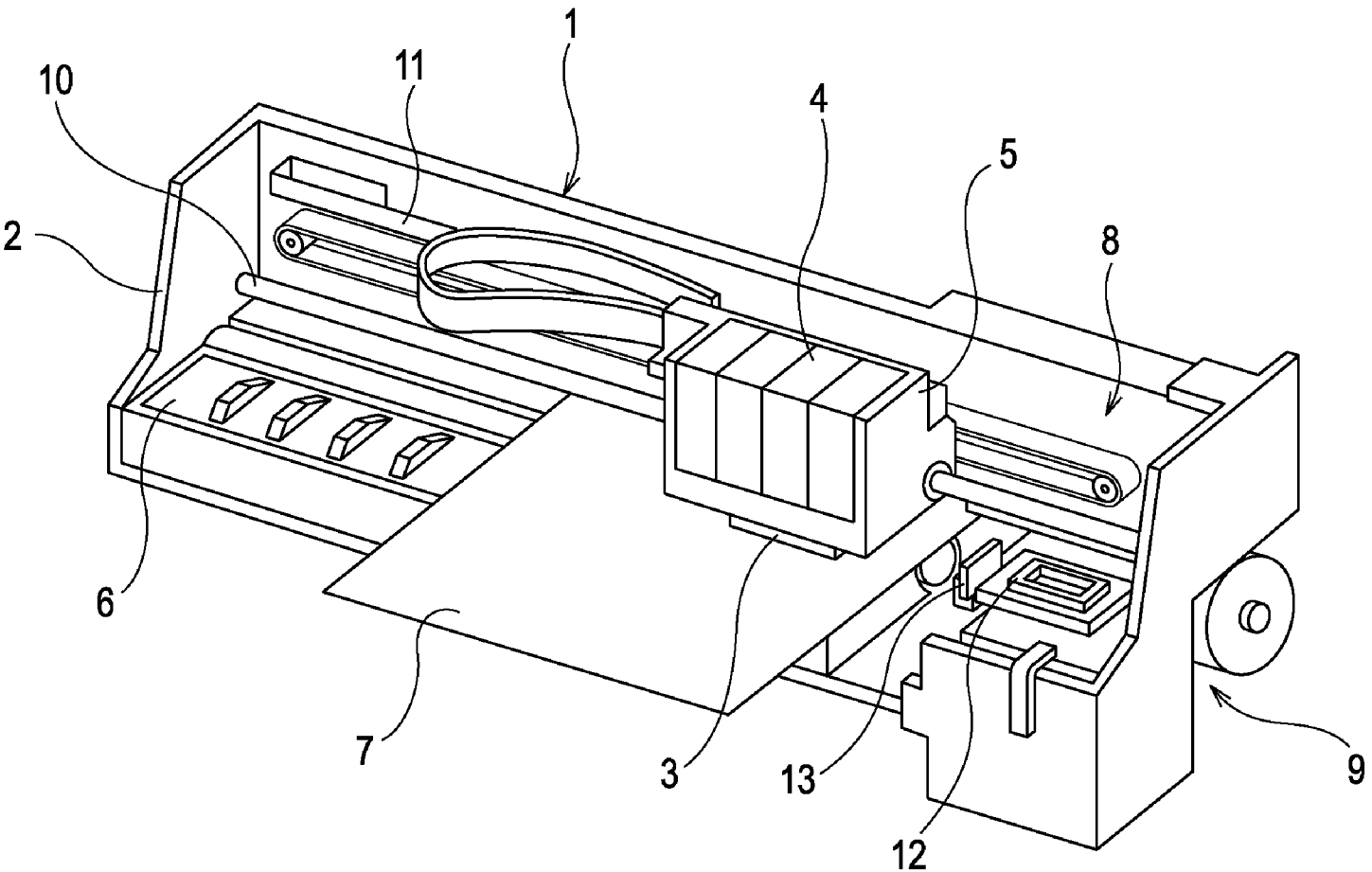
FIG. 1 is a perspective view explaining the configuration of a printer according to the invention.

FIG. 1 is a perspective view explaining the configuration of a printer 1. The printer 1 is roughly constituted to have, in the inside of a chassis 2, a carriage 5 on which a recording head 3 which is a kind of liquid discharging head is mounted and also on which an ink cartridge 4 which stores ink (equivalent to liquid in the invention) is detachably mounted, a platen 6 disposed below the recording head 3, a carriage movement mechanism 8 which reciprocates the carriage 5 (the recording head 3) in a paper width direction of a recording paper 7 (an impact target type), that is, a main scanning direction, and a paper feed mechanism 9 which transports the recording paper 7 in a sub-scanning direction which is the direction perpendicular to the main scanning direction. In addition, it is also possible to adopt a configuration in which the ink cartridge 4 is mounted on the chassis 2 side of the printer 1, thereby supplying ink to the recording head 3 through an ink supply tube.

The carriage 5 is mounted in a state where it is supported on a guide rod 10 mounted to extend in the main scanning direction, and is constituted so as to move in the main scanning direction along the guide rod 10 by an operation of the carriage movement mechanism 8. A position in the main scanning direction of the carriage 5 is detected by a linear encoder 11, and the detected signal, that is, an encoder pulse is sent to a control section 56 (refer to FIG. 3) of a printer controller. In this way, the control section 56 can control a recording operation (a discharge operation) by the recording head 3, or the like, while recognizing a scanning position of the carriage 5 (the recording head 3) on the basis of the encoder pulse from the linear encoder 11.

A home position which is a base point of scanning is set at an end area further outside (the right side in FIG. 1) than a recording area within the movement range of the carriage 5. At the home position in this embodiment, a capping member 12 which seals a nozzle formation face (a nozzle plate 32; refer to FIG. 2) of the recording head 3, and a wiper member 13 for wiping the nozzle formation face are disposed. Then, the printer 1 is configured such that so-called bidirectional recording is possible which records a character, an image, or the like onto the recording paper 7 in both directions at the time of forward movement in which the carriage 5 (the recording head 3) moves from the home position toward an end portion on the opposite side and the time of backward movement in which the carriage 5 returns from the end portion on the opposite side to the home position side.

Figure 2:
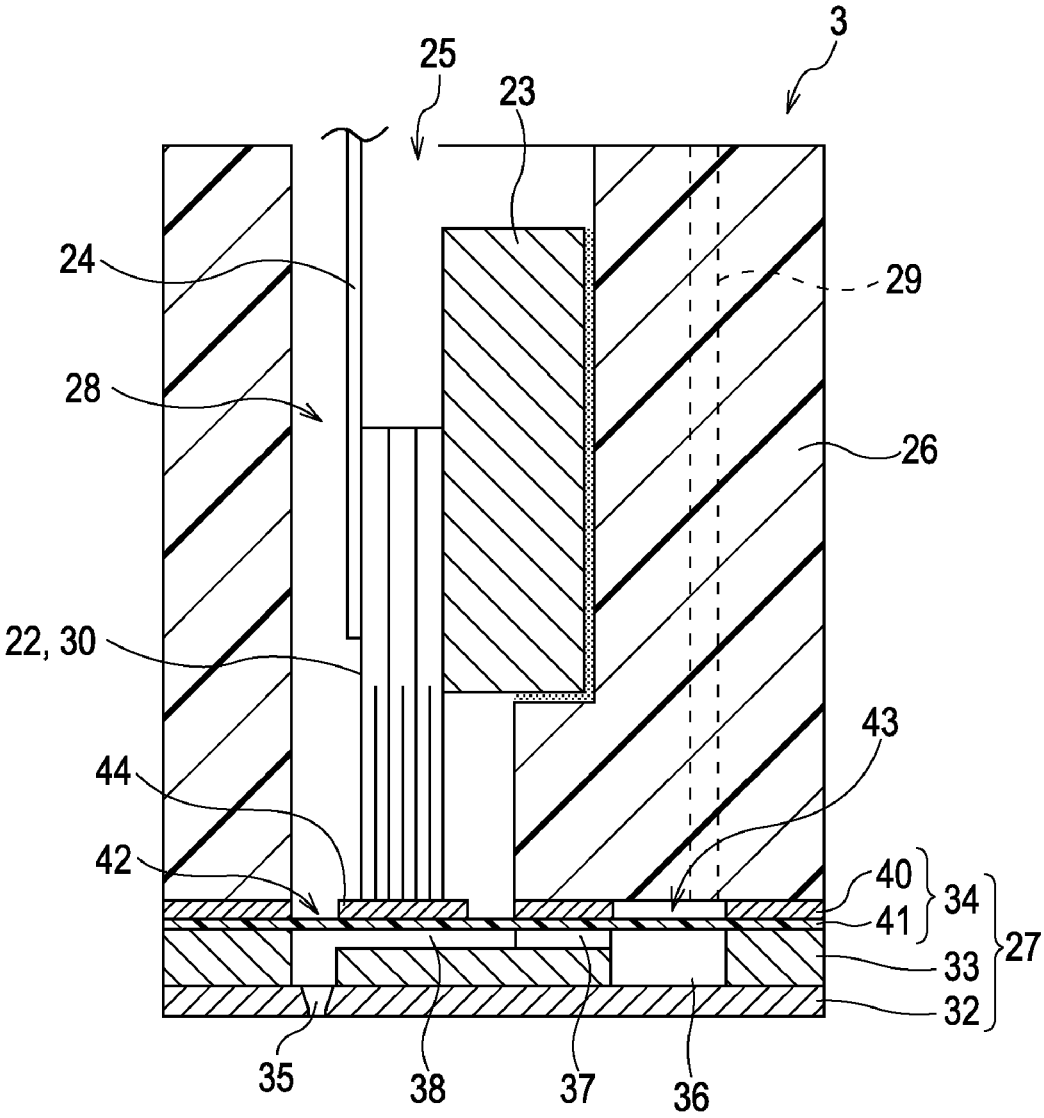
FIG. 2 is a cross-sectional view of a principal section of a recording head according to the invention.

FIG. 2 is a cross-sectional view of a principal section of the recording head 3 described above. The recording head 3 in this embodiment is constituted to have a vibrator unit 25 which is unitized with a piezoelectric vibrator group 22, a fixed plate 23, a flexible cable 24, and the like, a head case 26 which can house the vibrator unit 25, and a flow path unit 27 which forms a successive ink flow path (equivalent to a liquid flow path in the invention) reaching from a reservoir (a common ink chamber) 36 to a nozzle orifice 35 (equivalent to a nozzle in the invention) through a pressure chamber (a pressure generation chamber) 38.

First, the vibrator unit 25 will be described. A piezoelectric vibrator 30 (a kind of pressure generation element in the invention) constituting the piezoelectric vibrator group 22 is formed into a comb-teeth shape elongated in a longitudinal direction, and is carved into a very thin width in the order of several tens of μm. Then, the piezoelectric vibrator 30 is configured as a longitudinal vibration type piezoelectric vibrator capable of extending or contracting in a longitudinal direction. Each piezoelectric vibrator 30 is fixed in the state of a so-called cantilever beam with a fixed end portion joined to the fixed plate 23 and a free-end portion protruding further outward than the leading end edge of the fixed plate 23. Then, the leading end of the free-end portion of each piezoelectric vibrator 30 is joined to an island portion 44 which constitutes a diaphragm portion 42 of each flow path unit 27, as described later. The flexible cable 24 is electrically connected to the piezoelectric vibrator 30 at the side of the fixed end portion, which is the opposite side to the fixed plate 23. Also, the fixed plate 23 which supports each piezoelectric vibrator 30 is constituted by a metallic plate material having rigidity capable of bearing the reactive force from the piezoelectric vibrator 30. In this embodiment, the fixed plate is made of a stainless steel plate having a thickness in the order of 1 mm.

The head case 26 is a hollow box-shaped member made of, for example, epoxy series resin, and to the leading end face (the lower surface) thereof, the flow path unit 27 is fixed, and in a housing space portion 28 formed in the inside of the case, the vibrator unit 25 which is a kind of actuator is housed. Also, in the inside of the head case 26, a case flow path 29 is formed to penetrate in the height direction thereof. The case flow path 29 is a flow path for supplying ink from the ink cartridge 4 side to the reservoir 36.

Next, the flow path unit 27 will be described. The flow path unit 27 is constituted by the nozzle plate 32, a flow path formation substrate 33, and a vibration plate 34, and is constituted by disposing the nozzle plate 32 on the surface of one side of the flow path formation substrate 33 and the vibration plate 34 on the surface of the other side of the flow path formation substrate 33, which is the opposite side to the nozzle plate 32, so as to form a lamination, and then integrating them by adhesion or the like.

The nozzle plate 32 is a thin plate made of stainless steel, in which a plurality of nozzle orifices 35 are opened and provided in a row shape at a pitch corresponding to dot formation density. In this embodiment, for example, 180 nozzle orifices 35 are opened and provided in a row shape, and by these nozzle orifices 35, a nozzle row is constituted. Then, four nozzle rows are arranged in juxtaposition.

The flow path formation substrate 33 is a plate-like member, in which a successive ink flow path composed of the reservoir 36, an ink supply port 37, and a pressure chamber 38 is formed. Specifically, the flow path formation substrate 33 is a plate-like member in which a plurality of space portions that becomes the pressure chamber 38 is formed in a state where they are partitioned by partition walls to correspond to each nozzle orifice 35, and also in which space portions that become the ink supply port 37 and the reservoir 36 are formed. Then, the flow path formation substrate 33 of this embodiment is manufactured by etching a silicon wafer. The pressure chamber 38 is formed as a chamber which is elongated in the direction orthogonal to the row direction (a nozzle row direction) of the nozzle orifices 35, and the ink supply port 37 is formed as a narrowed portion with a narrow flow path width which allow the pressure chamber 38 and the reservoir 36 to communicate with each other. Also, the reservoir 36 is a chamber for supplying ink stored in the ink cartridge 4 to each pressure chamber 38 and communicates with a corresponding pressure chamber 38 through the ink supply port 37.

The vibration plate 34 is a composite plate material of a double structure in which a resin film 41 such as PPS (polyphenylene sulfide) is laminated on a support plate 40 made of metal such as stainless steel, and is a member which has the diaphragm portion 42 for sealing an opening face of one side of the pressure chamber 38 and changing the volume of the pressure chamber 38 and in which a compliance portion 43 that seals an opening face of one side of the reservoir 36 is formed. Then, the diaphragm portion 42 is constituted by performing etching on the support plate 40 of a portion corresponding to the pressure chamber 38 to annularly remove the portion, thereby forming the island portion 44 for joining the leading end of the free-end portion of the piezoelectric vibrator 30. The island portion 44 is of a block shape which is elongated in the direction orthogonal to the row direction of the nozzle orifices 35, similarly to the planar shape of the pressure chamber 38, and the resin film 41 around the island portion 44 functions as an elastic film. Also, a portion serving as the compliance portion 43, that is, a portion corresponding to the reservoir 36 is composed of only the resin film 41 as the support plate 40 is removed in accordance with the opening shape of the reservoir 36 by etching.

Then, since the leading end face of the piezoelectric vibrator 30 is joined to the island portion 44, the volume of the pressure chamber 38 can be varied by extending and contracting the free-end portion of the piezoelectric vibrator 30. Pressure fluctuations occur in ink in the pressure chamber 38 according to the volume variation. Then, the recording head 3 discharges an ink droplet (a kind of ink) from the nozzle orifice 35 by using the pressure fluctuations.

Next, an electrical configuration of the printer 1 will be described.

Figure 3:
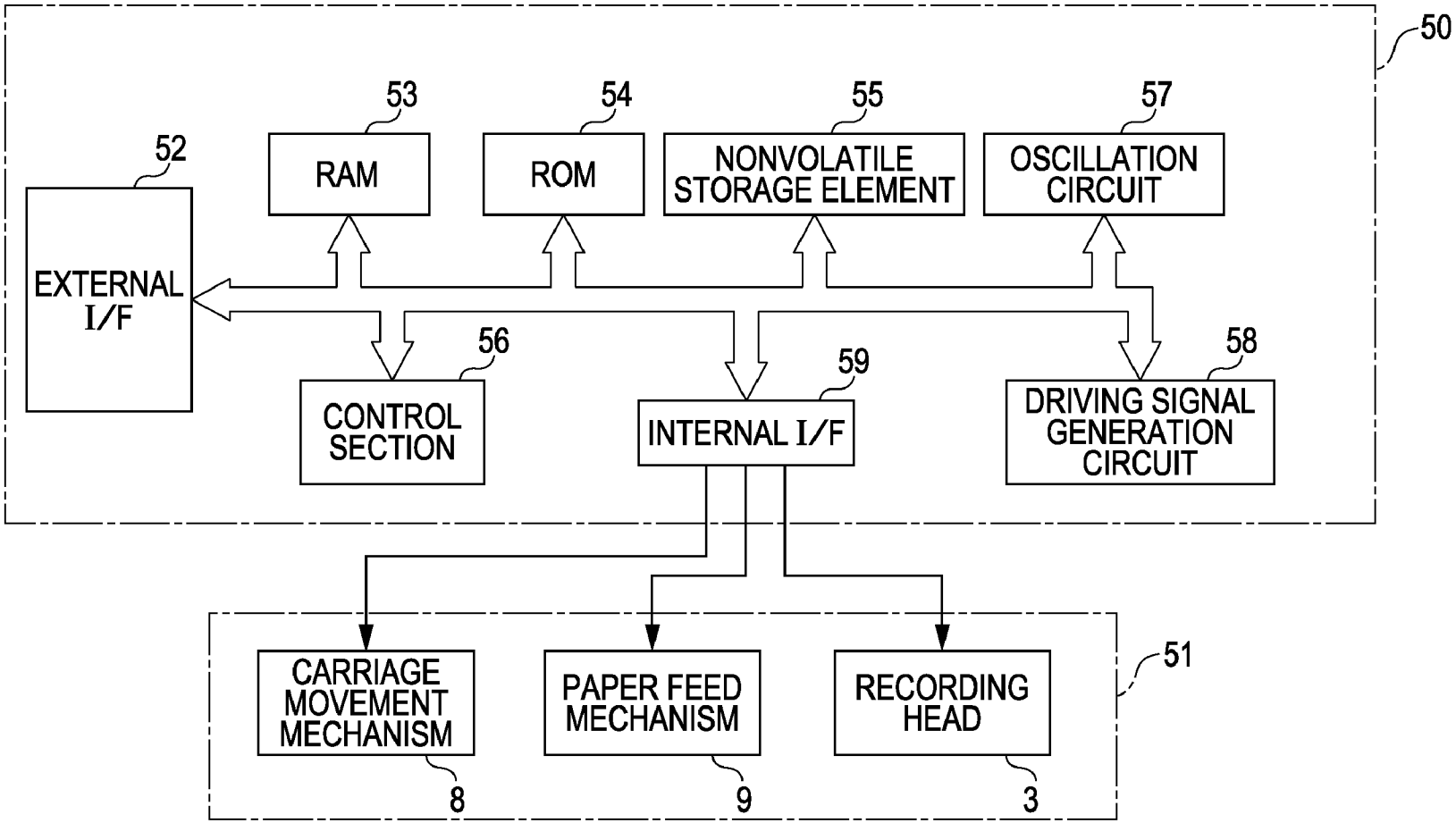
FIG. 3 is a block diagram explaining an electrical configuration of the printer according to the invention.

FIG. 3 is a block diagram explaining an electrical configuration of the printer 1. The printer 1 in this embodiment is constituted by a printer controller 50 and a print engine 51. The printer controller 50 includes an external interface (an external I/F) 52, to which print data or the like from an external apparatus such as a host computer is input, a RAM 53 which stores various data or the like, a ROM 54 which stores a control program for various control, or the like, a nonvolatile storage element 55 composed of an EEPROM, a flash ROM, or the like, the control section 56 (equivalent to a portion of a driving signal generation section in the invention) which performs comprehensive control of each section according to the control program stored in the ROM 54, an oscillation circuit 57 which generates a clock signal, a driving signal generation circuit 58 (equivalent to a portion of the driving signal generation section) which generates a driving signal COM that is supplied to the recording head 3, and an internal interface (an internal I/F) 59 for outputting dot pattern data, which is obtained by developing the print data for each dot, the driving signal, or the like to the recording head 3. Also, the print engine 51 is constituted by the recording head 3, the carriage movement mechanism 8, and the paper feed mechanism 9.

The control section 56 controls discharge control of ink droplets by the recording head 3, or each section of the printer 1 other than it, according to an operation program stored in the ROM 54, or the like. The control section 56 converts the print data input from the external apparatus through the external I/F 52 into discharge data which is used in discharge of ink droplets in the recording head 3. The discharge data after conversion is transmitted to the recording head 3 through the internal I/F 59, and in the recording head 3, supply of the driving signal COM to the piezoelectric vibrator 30 is controlled on the basis of the discharge data, whereby discharge of ink droplets, that is, a recording operation (a discharge operation) is performed. In this manner, the driving signal generation section in the invention is constituted by the control section 56 and the driving signal generation circuit 58.

Figure 4:
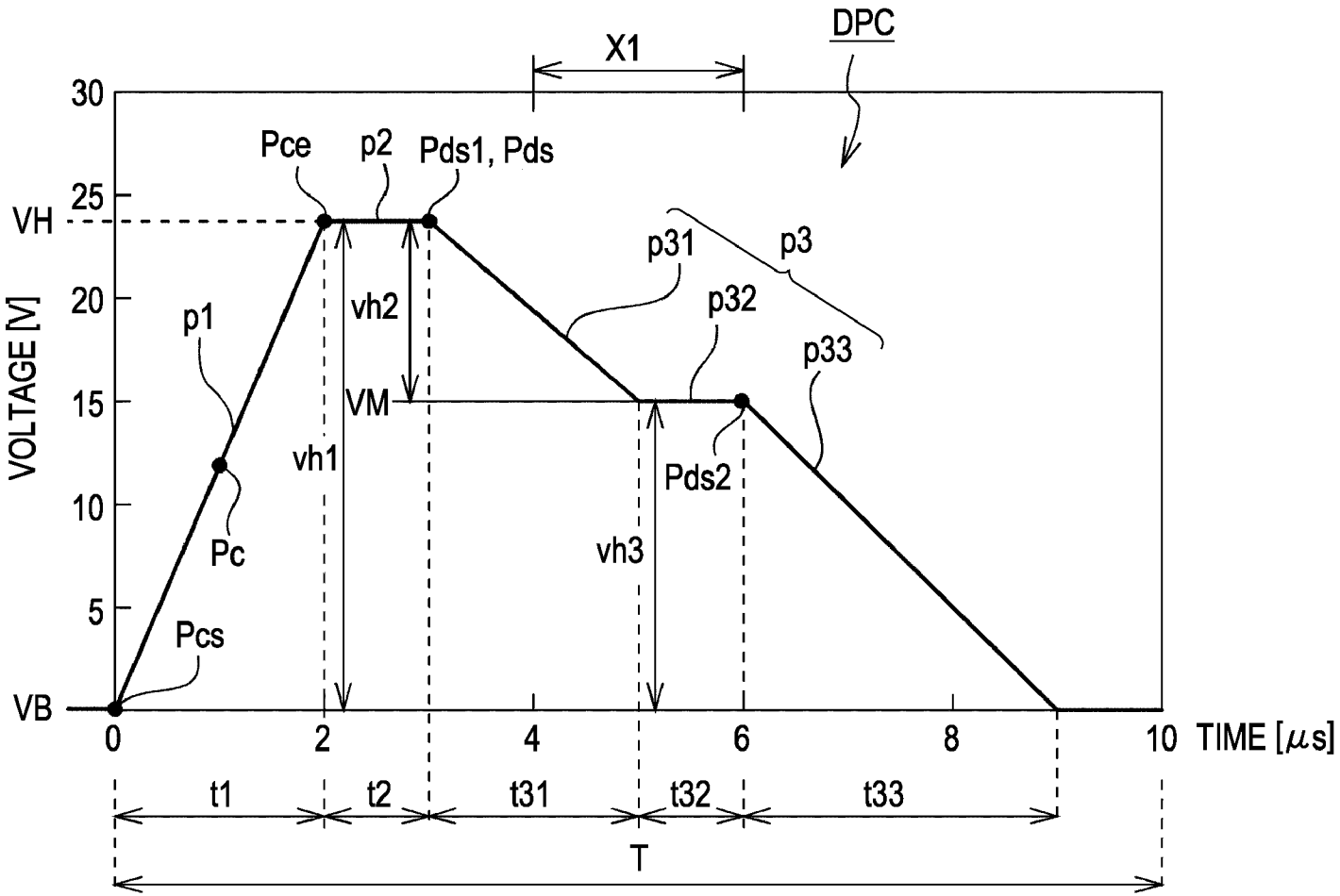
FIG. 4 is a waveform diagram explaining the configuration of a micro-vibration pulse according to the invention.

FIG. 4 is a waveform diagram explaining the configuration of a micro-vibration pulse DPC which is included in the driving signal COM which is generated by the driving signal generation circuit 58 having the above configuration. In addition, in FIG. 4, a vertical axis indicates voltage [V] of the micro-vibration pulse DPC and a horizontal axis indicates a time [μs].

The micro-vibration pulse DPC illustrated is a driving pulse which is different from a discharge pulse that is used in normal ink discharge, and is a driving pulse which is used for agitating ink thickened in the recording head 3. The micro-vibration pulse DPC in this embodiment is set to be a driving voltage VH (a voltage change amount type; for example, about 24 V which is equal to or greater than twice an existing micro-vibration pulse) higher than a micro-vibration pulse (for example, 10 V) for micro-vibrating liquid having relatively low viscosity like water-based ink. This micro-vibration pulse DPC is constituted by an expansion portion p1 (equivalent to a first voltage change portion in the invention), in which voltage changes at a voltage change amount vh1 of a relatively steep and constant gradient to the plus side (in a first direction) from a reference voltage VB up to an expansion voltage VH within a duration t1 (for example, 2.0 μs), thereby rapidly expanding the pressure chamber 38, an expansion maintaining portion p2 which maintains the expansion voltage VH, which is a termination voltage of the expansion portion p1, for a given (short) length of time (a duration t2, for example, 1.0 μs), and a contraction portion p3 (equivalent to a second voltage change portion in the invention), in which voltage changes at a gentle and constant gradient to the minus side (in a second direction) from the expansion voltage VH up to the reference voltage VB within a duration t3 (t31+t32+t33 (for example, 6.0 μs)), thereby relatively gently contracting the pressure chamber 38.

Also, the contraction portion p3 in this embodiment includes a first contraction element p31 (equivalent to a first change element in the invention) which follows the expansion maintaining portion p2 and in which voltage changes at a voltage change amount vh2 of a constant gradient to the minus side from the expansion voltage VH up to an intermediate voltage VM (for example, about 15 V) within a duration t31 (for example, 2.0 μs), thereby contracting the pressure chamber 38, a contraction maintaining element p32 which follows the first contraction element p31 and maintains the intermediate potential VM, which is the termination voltage of the first contraction element p31, for a given (short) length of time (a duration t32, for example, 1.0 μs), and a second contraction element p33 (equivalent to a second change element in the invention) which follows the contraction maintaining element p32 and in which voltage changes at a voltage change amount vh3 of a constant gradient to the minus side from the voltage VM up to the reference voltage VB within a duration t33 (for example, 3.0 μs), thereby contracting the pressure chamber 38.

Figures 5, 6:
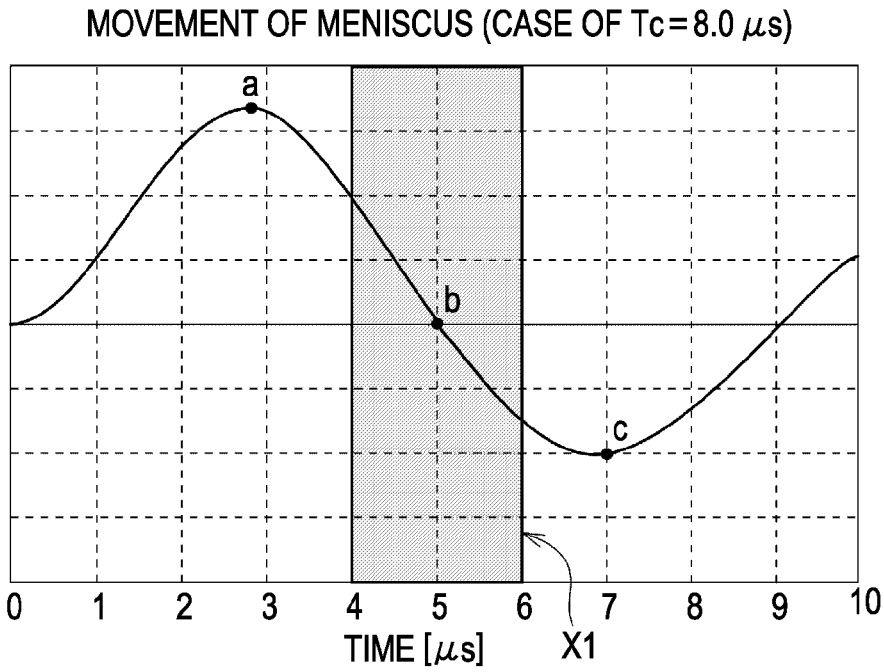
FIG. 5 is a schematic diagram explaining movement of a meniscus when an expansion portion according to the invention has been supplied.
FIG. 6 is a table showing existence and nonexistence of discharge of an ink droplet when a duration from an end point time of supply of the expansion portion according to the invention to a start point time of supply of a contraction portion is changed.

Next, movement of a meniscus in the nozzle orifice 35 (the free surface of ink in the nozzle orifice 35) when supplying (applying) the micro-vibration pulse DPC to the piezoelectric vibrator 30 will be described. FIG. 5 is a schematic diagram explaining movement (vibration) of the meniscus when the expansion portion p1 has been applied, and shows a vibration state when waveform elements subsequent to the expansion portion p1 are not applied to the piezoelectric vibrator 30. In addition, in FIG. 5, a vertical axis indicates a position (in the drawing, the lower side is a discharge side and the upper side is a pressure chamber 38 side) of the meniscus and a horizontal axis indicates a time [μs] and coincides with the time [μs] in FIG. 4. A natural vibration period Tc of ink in the pressure chamber 38 in the recording head 3 is set to be 8.0 μs.

In addition, the natural vibration period Tc is a value which is determined according to the shape or the like of the nozzle orifice 35 or the pressure chamber 38, and the vibration period Tc of ink in the pressure chamber 38 can be represented by the following expression (A).

$$Tc=2\pi\sqrt{[[(Mn\times Ms)/\{Mn+Ms\}]\times Cc]} \quad (A)$$

In this regard, in the expression (A), Mn is an inertance in the nozzle orifice 35, Ms is an inertance in the ink supply port 37 which communicates with the pressure chamber 38, and Cc is compliance (a volume change per unit pressure; it represents the degree of softness) of the pressure chamber 38. In the above expression (A), an inertance M represents ease of movement of ink in the ink flow path and is mass of ink per unit cross-sectional area. Then, when the density of ink is ρ, a cross-sectional area of a surface perpendicular to an ink flow direction in the flow path is S, and the length of the flow path is L, the inertance M can be represented approximately by the following expression (B).

$$\text{Inertance } M=(\text{density } \rho\times\text{length } L)/\text{cross-sectional area } S \quad (B)$$

Also, Tc is not limited to the above expression (B), but may be a vibration period that the pressure chamber 38 has.

First, if the expansion portion p1 among the micro-vibration pulse DPC is applied to the piezoelectric vibrator 30, the piezoelectric vibrator 30 contracts in the longitudinal direction of the element, whereby the pressure chamber 38 rapidly expands from a reference volume corresponding to the reference voltage VB up to the maximum volume (the maximum volume in a micro-vibration operation) corresponding to the maximum voltage VH (an expansion process (equivalent to a first change process in the invention)). Due to this expansion process, as shown in FIG. 5, the meniscus of ink in the nozzle orifice 35 is greatly drawn to the pressure chamber 38 side (the upper side in FIG. 5) and also ink is supplied from the reservoir 36 side into the pressure chamber 38 through the ink supply port 37. Then, an expansion state of the pressure chamber 38 in the expansion process is constantly maintained during a supply period t2 of the expansion maintaining portion p2 (an expansion maintaining process). The meniscus drawn to the pressure chamber 38 side is further drawn up to the maximum draw-in position (this position is shown by symbol a in FIG. 5) by an inertia force due to draw-in in the expansion process, at a time slightly later than a supply period t1 of the expansion portion p1, that is, the supply period t2 of the expansion maintaining portion p2.

Then, the meniscus drawn up to the maximum draw-in position a is in turn pushed out to the discharge side (the lower side in FIG. 5), thereby repeating damping vibration in which the meniscus is further pushed out up to a position (this position is shown by symbol c in FIG. 5) past an original position (this position is shown by symbol b in FIG. 5) due to an inertial force at this time and thereafter, the meniscus is drawn to the pressure chamber 38 again. In addition, vibration of the meniscus due to supply of the expansion portion p1 to the piezoelectric vibrator 30 has a waveform approximately equal to a sine wave, in which a starting point (a point in time of 0 in FIG. 5) thereof corresponds with an intermediate point in time Pc of supply which is the middle between a start point time of supply (indicated by symbol Pcs in FIG. 4) of the expansion portion p1 and an end point time of supply (indicated by symbol Pce in FIG. 4) of the expansion portion p1, and becomes damping vibration in which a vibration amplitude gradually dampens in a vibration period according to the natural vibration period Tc of ink in the pressure chamber 38.

If the first contraction element p31 of the contraction portion p3 is supplied to the piezoelectric vibrator 30 following the expansion maintaining portion p2, the piezoelectric vibrator 30 extends, whereby the pressure chamber 38 gently contracts from the maximum volume up to an intermediate volume corresponding to the intermediate voltage VM (a first contraction treatment (being a portion of a second change process in the invention and equivalent to a first change treatment)). Due to this contraction of the pressure chamber 38, ink in the pressure chamber 38 is pressurized, whereby a pressure fluctuation is provided to ink in the pressure chamber 38 to the extent that ink from the nozzle orifice 35 is not discharged, so that ink in the pressure chamber 38, which includes the meniscus, is agitated. Then, a contraction state of the pressure chamber 38 in the first contraction treatment is constantly maintained over a supply period of the contraction maintaining element p32 (a contraction maintaining treatment (being a portion of the second change process in the invention and equivalent to a holding treatment)). If the second contraction element p33 is supplied to the piezoelectric vibrator 30 following the contraction maintaining element p32, the piezoelectric vibrator 30 further extends, whereby the pressure chamber 38 gently contracts and returns from the intermediate volume up to a reference volume corresponding to the reference voltage VB (a second contraction treatment (being a portion of the second change process in the invention and equivalent to a second change treatment)).

Here, explanations are given for results of experiments which measured whether or not ink droplets from the nozzle orifice 35 were discharged when a time from the end point time Pce (in this embodiment, a point in time of 2 [μs] in FIG. 4) of the expansion portion p1 to the start point time of supply (symbol Pds in FIG. 4) of the contraction portion p3, that is, the supply period t2 of the expansion maintaining portion p2 was changed. According to FIG. 6, in a case where the supply period t2 of the expansion maintaining portion p2 was 1 μs (in FIG. 5, in a case where the start point time of supply, Pds, of the contraction portion p3 was 3 μs, that is, outside the range of X1 shown by hatching), erroneous discharge of ink from the nozzle orifice 35 did not occur. Also, in a case where the supply period t2 was 2 μs to 4 μs (in FIG. 5, in a case where the start point time of supply of the contraction portion p3 was 4 to 6 [μs], that is, within the range of X1), ink was erroneously discharged from the nozzle orifice 35. Further, in a case where the supply period t2 was 5 μs (in FIG. 5, in a case where the start point time of supply of the contraction portion p3 was 7 [μs], that is, outside the range of X1), erroneous discharge of ink from the nozzle orifice 35 did not occur. That is, when the start point time of supply, Pds, of the contraction portion p3 is in the range (X1) of Pc+Tc/2±Tc/8, erroneous discharge occurs.

In view of the above points, in the printer 1 according to the invention, by setting the duration t2 from the end point time Pce of the expansion portion p1 of the micro-vibration pulse DPC to the start point time of supply, Pds, of the contraction portion p3 in accordance with the natural vibration period Tc of ink in the pressure chamber 38, even if the driving voltage VH is increased more than a driving voltage of an existing micro-vibration pulse, amplification of vibration of the meniscus by composition of residual vibration by the expansion portion p1 and a pressure fluctuation by the contraction portion p3 is suppressed, so that generation of erroneous discharge of ink is suppressed. Specifically, a condition in which the above erroneous discharge does not occur is in ensures that the start point time of supply, Pds, of the contraction portion p3 does not fall within the range X1, and to satisfy the following expression (C) or (D). In addition, the Pds is larger than the Pce.

$$Pds<Pc+Tc/2-Tc/8 \quad (C)$$

$$Pds>Pc+Tc/2+Tc/8 \quad (D)$$

The above expressions (C) and (D) are respectively modified as follows.

$$\text{Expression (C): } Pds<Pc+3Tc/8 \quad (C')$$

$$\text{Expression (D): } Pds>Pc+5Tc/8 \quad (D')$$

Then, from the relationship of Pc=(Pcs+Pce)/2, the start point time Pds of the contraction portion p3 is set to be in the range of any one of the following expressions (1) and (2).

$$Pds<(Pcs+Pce)/2+3Tc/8 \quad (1)$$

$$Pds>(Pcs+Pce)/2+5Tc/8 \quad (2)$$

Here, by being set in this manner, the contraction portion p3 is supplied to the piezoelectric vibrator 30 at the timing avoiding the range X1 (the hatched portion in FIG. 5) as much as possible in which the meniscus rapidly moves to a discharge direction by residual vibration when supplying the expansion portion p1 to the piezoelectric vibrator 30.

In this manner, in the printer 1 of this embodiment, by setting the start point time of supply, Pds, of the contraction portion p3 at the timing avoiding as much as possible the range (the range of 4 μs to 6 μs shown by a hatched line X1 in FIG. 5) in which the meniscus in the nozzle orifice 35 rapidly moves to the discharge side by the residual vibration of ink in the pressure chamber 38 due to supply of the expansion portion p1 to the piezoelectric vibrator 30, even if the driving voltage VH is increased more than a driving voltage of an existing micro-vibration pulse, it is possible to suppress amplification of vibration of the meniscus due to composition of the residual vibration by the expansion portion p1 and a pressure fluctuation by the contraction portion p3. In addition to this, since a pause period is provided in a pressure change by providing the contraction maintaining element p32 in the middle of the contraction portion p3, in comparison with a configuration of changing pressure at once without providing a pause period, excessive vibration of the meniscus is prevented. In this way, by supplying the micro-vibration pulse DPC, in which the driving voltage VH is higher than conventionally, to the piezoelectric vibrator 30, it is possible to provide pressure fluctuations to ink in the nozzle orifice 35 to the extent that does not discharge ink droplets. As a result, generation of erroneous discharge in which ink is erroneously discharged from the nozzle orifice 35 can be suppressed, and ink is efficiently agitated, so that thickening of ink can be suppressed. Also, even if a waveform length of the micro-vibration pulse DPC is not lengthened, since generation of erroneous discharge can be suppressed, high-frequency driving becomes possible and also the degree of freedom of design of a waveform (a pulse) can be increased.

Also, in the micro-vibration driving pulse DPC of this embodiment, the distance between the start point time of supply (indicated by symbol Pds1 (=the start point time of supply, Pds, of the contraction portion p3) in FIG. 4) of the first contraction element p31 in the contraction portion p3 and the start point time of supply (indicated by symbol Pds2 in FIG. 4) of the second contraction element p33, that is, the total duration (t31+t32) of the duration t31 of the first contraction element p31 and the duration t32 of the contraction maintaining element p32 is set to be Tc/4 or more and 3Tc/4 or less, and a voltage change amount vh2 between them is set to be in the range of 20% to 50% of an overall amount of voltage change vhl (a difference between the reference voltage VB and the expansion voltage VH).

As a result, it is possible to sufficiently agitate ink without lengthening the waveform length of the micro-vibration pulse DPC more than necessary and generating erroneous discharge. That is, by setting the voltage change amount vh2 of the first contraction element p31 to be in the range of 20% to 50% of the overall amount of voltage change, erroneous discharge when the first contraction element p31 is supplied to the piezoelectric vibrator 30 is more reliably prevented. Also, by setting the distance between the starting point time Pds1 of the first contraction element p31 and the starting point time Pds2 of the second contraction element p33 to be Tc/4 or more and 3Tc/4 or less, vibration of the meniscus, which is generated by the first contraction element p31, and vibration of the meniscus, which is generated by the second contraction element p33, act to cancel each other, so that it is possible to effectively agitate ink without lengthening the waveform length of the micro-vibration pulse DPC more than necessary and generating erroneous discharge.

Also, the above configuration is suitable for a case where ink (high-viscosity liquid) having higher viscosity than that of existing ink, in which viscosity is 8 mPa·s or more, like light curing ink which is hardened by irradiation of light energy such as ultraviolet rays, for example, is discharged or a case where natural thickening of ink is promoted. In this case, it is difficult for the ink to be shaken by pressure fluctuations compared with ink having low viscosity like water-based ink which has been discharged conventionally, and in a case where a micro-vibration operation is performed on the high-viscosity liquid, there is a need to provide large pressure fluctuations by making a voltage change amount of the micro-vibration pulse larger than the case of low-viscosity liquid such as existing water-based ink. However, if micro-vibration is performed by using the above micro-vibration pulse DPC, while generation of erroneous discharge is suppressed, liquid is efficiently agitated, thereby allowing thickening of liquid to be suppressed.

In addition, the invention is not to be limited to the above embodiments and various modifications are possible on the basis of the description of the claims.

In the above embodiments, as one example of the micro-vibration pulse DPC in the invention, the micro-vibration pulse DPC shown in FIG. 4 is given. However, the shape of the pulse is not limited to the illustrated shape and a pulse of an arbitrary waveform can be used. That is, the number of contraction maintaining elements p32 which are included in the contraction portion p3 of the micro-vibration pulse DPC is not limited to one, but the driving signal COM may be constituted by two or more driving pulses DP and the contraction portion p3 of the micro-vibration pulse DPC may have three or more contraction elements.

Also, in the above embodiment, as the pressure generation element, the piezoelectric vibrator 30 of a so-called longitudinal vibration mode is illustrated. However, it is not limited thereto. For example, even in a case where a piezoelectric vibrator of a so-called flexural vibration mode or a heat generation element is used, it is possible to apply the invention. In addition, in a case where the piezoelectric vibrator of a so-called flexural vibration mode is adopted, the waveform of the micro-vibration pulse DPC shown in FIG. 4 is turned upside down.

Then, provided that it is a liquid discharging apparatus in which discharge control can be performed by using a plurality of driving signals, the invention is not limited to a printer, but can also be applied to various ink jet type recording apparatuses such as a plotter, a facsimile apparatus, or a copy machine, or liquid discharging apparatuses other than a recording apparatus, for example, a display manufacturing apparatus, an electrode manufacturing apparatus, a chip manufacturing apparatus, and the like.

What is claimed is:

1. A liquid ejecting apparatus comprising:

a pressure generating element that generates a pressure applied to the pressure chamber;

a liquid discharging head which provides pressure fluctuations into a pressure chamber to eject liquid from a nozzle; and a driving signal generation section which generates a driving signal including a micro-vibration pulse which drives the pressure generation element, thereby vibrating liquid in the nozzle to an extent that does not discharge liquid from the nozzle, wherein the micro-vibration pulse includes a first voltage change portion in which voltage changes in a first direction of changing the voltage, and a second voltage change portion which occurs subsequent to the first voltage change portion and in which voltage changes in a second direction opposite to the first direction, the second voltage change portion includes a first change element which occurs subsequent to the first change portion and in which voltage changes in the second direction, a voltage maintaining element which follows the first change element and maintains a termination voltage of the first change element, and a second change element which follows the voltage maintaining element and in which voltage changes in the second direction, and when a time from a start point time of the first voltage change portion to an end point time of the first voltage change portion is set as t1, a time from the end point time of the first voltage change portion to a start point time of the second voltage change portion is set as t2, and a natural vibration period of liquid in a liquid flow path including the pressure chamber is set as Tc, the start point time (t1+t2) of the second voltage change portion is set to be in the range of any one of the following expressions:

$$(t1+t2)<t1/2+3Tc/8;\text{ or}$$

$$(t1+t2)>t1/2+5Tc/8.$$

2. The liquid ejecting apparatus according to claim 1, wherein an interval between a start point time of the first change element and a start point time of the second change element in the second voltage change portion is set to be Tc/4 or more and 3Tc/4 or less, and a voltage change amount between them is set to be in the range of 20% to 50% of an overall amount of voltage change of the micro-vibration pulse.

3. The liquid ejecting apparatus according to claim 1, wherein the liquid has viscosity of 8 mPa·s or more.

4. A method of liquid discharge control comprising providing a liquid discharging apparatus including:

a liquid ejecting head, and a driving signal generation section which generates a driving signal including a micro-vibration pulse which drives a pressure generation element, thereby vibrating liquid in a nozzle to an extent that does not discharge liquid from the nozzle, wherein the micro-vibration pulse includes:

a first voltage change portion in which voltage changes in a first direction of changing the voltage, and a second voltage change portion which occurs subsequent to the first voltage change portion and in which voltage changes in a second direction opposite to the first direction, and the second voltage change portion includes a first change element which occurs subsequent to the first change portion and in which voltage changes in the second direction, a voltage maintaining element which follows the first change element and maintains a termination voltage of the first change element, and a second change element which follows the voltage maintaining element and in which voltage changes in the second direction, the method comprising:

executing a first change process which changes volume of the pressure chamber by providing the first voltage change portion; and executing a second change process which changes the pressure chamber volume changed by providing the first voltage change process, by providing the second voltage change portion, wherein executing the second change process includes executing:

a first change treatment which changes partway the pressure chamber volume changed in the first change process, by providing the first voltage change element, a holding treatment which maintains the pressure chamber volume changed in the first change treatment for a given length of time, and a second change treatment which changes the pressure chamber volume maintained in the holding treatment, by providing the second voltage change element, and when a time from a start point time of the first voltage change process to an end point time of the first voltage change process is set as t1, a time from the end point time of the first voltage change process to a start point time of the second voltage change process is set as t2, and a natural vibration period of liquid in a liquid flow path including the pressure chamber is Tc, the start point time (t1+t2) of the second voltage change process is set to be in the range of any one of the following expressions:

$$(t1+t2)<t1/2+3Tc/8;\text{ or}$$

$$(t1+t2)>t1/2+5Tc/8.$$

* * * * *